United States Patent [19]

Goffe

[11] 4,123,283

[45] Oct. 31, 1978

[54] SETTING ELECTRICAL LATENT IMAGES IN MIGRATION IMAGING ELEMENTS

[75] Inventor: William L. Goffe, Webster, N.Y.

[73] Assignee: Xerox Corporation, Stamford, Conn.

[21] Appl. No.: 349,506

[22] Filed: Apr. 9, 1973

[51] Int. Cl.[2] ..... G03G 13/22

[52] U.S. Cl. ..... 96/1 PS; 96/1.5 R; 427/145; 427/161; 346/153

[58] Field of Search ..... 96/1 R, 1 PS, 1 M, 1.5; 117/1.7; 340/173 R, 173 RC; 346/74 R, 74 ES, 74 P

[56] References Cited

U.S. PATENT DOCUMENTS

| | | | |
|---|---|---|---|
| 3,556,781 | 1/1971 | Levy et al. | 96/1 PS |
| 3,648,607 | 3/1972 | Gundlach | 96/1 PS |
| 3,677,750 | 7/1972 | Mammino et al. | 96/1 PS |
| 3,719,482 | 3/1973 | Goffe | 96/1 PS |

*Primary Examiner*—Roland E. Martin, Jr.

[57] ABSTRACT

A migration layer comprising migration material and softenable material, said migration layer having a set electrical latent image. The process of setting the electrical latent image comprises providing an imaging member comprising the above migration layer, electrically latently imaging the migration layer and setting the electrical latent image by either storing the migration layer in the dark or applying heat, applying vapor, or applying partial solvents in a pre-development softening step. After setting of the electrical latent image, the migration layer can be exposed to activating electromagnetic radiation without loss of the latent image and permitted long delays of up to years between formation of the electrical latent image and the development step which allow selective migration in depth.

33 Claims, 2 Drawing Figures

SETTING ELECTRICAL LATENT IMAGES IN MIGRATION IMAGING ELEMENTS

BACKGROUND OF THE INVENTION

This invention relates in general to imaging and more specifically to migration imaging and a process for setting, i.e., stabilizing migration imaging electrical latent images.

Recently, a migration image system capable of producing high quality images of high density, continuous tone, and high resolution has been developed. Such migration imaging systems are disclosed in copending applications Ser. No. 837,780, now U.S. Pat. No. 3,975,195, and Ser. No. 837,591, now U.S. Pat. No. 4,013,462, both filed June 30, 1969 which are hereby expressly incorporated herein by reference. In a typical embodiment of the new migration imaging system an imaging member comprising a substrate with a migration layer comprising a layer of softenable material and electrically photosensitive migration material is imaged in the following manner: an electrical latent image is formed on the member, for example, by electrically charging the member and exposing it to a pattern of activation electromagnetic radiation such as light. Where the photosensitive migration material is layered in but spaced apart from one surface of the softenable material layer (the layer configuration), migration material from the migration layer migrates imagewise toward the substrate when the member is developed by softening the softenable layer.

One mode of development entails exposing the member to a solvent which dissolves only the softenable layer. The photosensitive migration material (typically particles) which has been exposed to radiation migrates through the softenable layer as it is softened and dissolved, leaving an image of migrated particles corresponding to the radiation pattern of an original on the substrate with the material of the softenable layer substantially washed away. The particle image may then be fixed to the substrate. For many preferred photosensitive migration particles, the image produced by the above process is a negative of a positive original, i.e., particles deposite in image configuration corresponding to the radiation exposed areas. Those portions of the photosensitive material which do not migrate to the substrate are washed away by the solvent with the softenable material layer. However, positive to positive systems are also possible by varying imaging parameters. As disclosed in the referenced applications, by other developing techniques, the softenable material layer may at least partially remain behind on the supporting substrated with or without a relatively unmigrated pattern of migration material complementary to said migrated material.

In another imaging member embodiment, the migration layer comprises migration material dispersed throughout the softenable material layer in a binder layer configuration.

"Softenable" as used herein is intended to mean any substantially insulating material which can be rendered more permeable to migration material migrating through its bulk. Conventionally, changing permeability is accomplished by dissolving, partially dissolving, melting, and softening as by contact with heat, vapors, partial solvents and combinations thereof.

The term "electrical latent image" and the several variant forms thereof used herein includes the images formed by the charge-expose mode hereof which cannot readily be detected by standard electrometric techniques as an electrostatic image for example of the type found in xerography, so that no readily detectable or at best a very small change in the electrostatic or coulombic force is found after exposure (when using preferred exposure levels); and electrostatic latent images of a type similar to those found in xerography which are typically readily measurable by standard electrometers, that is the electrostatic latent images show a surface potential reading typically of at least about 5 to 10 volts.

"Fracturable" layer or material as used herein, means any layer or material which is capable of breaking up during development, thereby permitting portions of said layer to migrate toward the substrate in image configuration. The fracturable layer may be particulate or semi-continuous in various embodiments of the migration imaging members.

"Contiguous," for the purpose of this invention, is defined as in *Webster's New Collegiate Dictionary,* Second Edition, 1960; "In actual contact; touching; also, near, though not in contact; adjoining."

In certain methods of forming the latent image, nonphotosensitive or inert, fracturable layers and particulate material may be used to form images, for example, wherein an electrostatic latent image isformed by a wide variety of methods including charging in image configuration through the use of a mask or stencil; first forming such a charge pattern on a separate photoconductive insulating layer according to conventional xerographic reproduction techniques and then transferring this charge pattern to the imaging member by bringing the two layers into very close proximity and utilizing breakdown techniques as described for example, in Carlson U.S. Pat. No. 2,982,647 and Walkup U.S. Pat. Nos. 2,825,814 and 2,937,943. In addition, charge patterns conforming to selected, shaped electrodes or combinations of electrodes may be formed by the discharge techniques as more fully described in Schwertz U.S. Pat. Nos. 3,023,731 and 2,919,967 or by the techniques described in Walkup U.S. Pat. Nos. 3,001,848 and 3,001,849 as well as by electron beam recording techniques, for example, as described in Glenn U.S. Pat. No. 3,113,179.

The characteristics of the images produced are dependent on such process steps as charging, exposure and development, as well as the particular combination of process steps. High density, continuous tone and high resolution are some of the image characteristics possible. The image is generally characterized as a fixed or unfixed particulate image with or without a portion of the softenable layer and unmigrated portions of the layer left on the imaged member.

As a consequence of working on this new migration imaging system, the present invention permits migration imaging latent electrical images to be set, so that the electrically latently imaged migration imaging member may be stored in its latent imaged condition for extended periods of time, for example, for days, months and even years before being developed to cause migration in depth in the softenable layer. Surprisingly, in many cases, setting also permits development to take place in ambient room light which is ordinarily activating for the migration imaging member.

SUMMARY OF THE INVENTION

It is, therefore, an object of this invention to provide a new system of setting migration image electrical latent images.

It is another object of this invention to provide a migration imaging method permitting development and allowing handling of migration image electrically latent imaged films in ambient actinic radiation, e.g. room light shortly after exposure.

it is another object of this invention to provide a migration imaging method which permits optical monitoring of film development in visible activating light shortly after formation of the latent image so that film development can be optimized for the particular latent image on the film.

The foregoing objects and others are accomplished in accordance with this invention by providing a migration imaging member comprising a migration layer comprising softenable material and migration material, electrically latently imaging the migration layer and then setting the electrical latent image by either a slight pre-development softening insufficient to cause imagewise migration of migration material in depth in the softenable layer or by storing the member in the dark. Setting the electrical latent image permits the member to be handled in ambient activating radiation, without destroying the latent image and permits long delays of days, months and even years between formation of the electrical latent image and development to cause selective migration in depth.

For many photosensitive migration materials pre-development softening also may increase the apparent sensitivity to light of the imaging member up to about two times that of normal imaging with no pre-development softening step.

BRIEF DESCRIPTION OF DRAWINGS

The advantages of this invention will become apparent upon consideration of the following detailed disclosure of the invention, especially when taken in conjunction with the accompanying drawings wherein.

DESCRIPTION OF THE PREFERRED EMBODIMENTS

Figure 1:
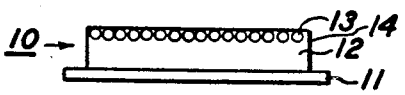
FIG. 1 is a partially schematic drawing of an imaging member having a layered configuration migration layer suitable for having electrical latent images formed thereon and set according to the present invention.

Referring now to FIG. 1, there is shown imaging member 10 comprising a migration layer 14 and a substrate 11. Migration layer 14 comprises migration material 13 and a layer 12 of softenable material. The substrate 11 is preferably a conductive material but can be an insulating material or a combination of both such as a thin conductive layer over an insulating layer. The substrate may be mechanically rigid or flexible, transparent or opaque depending upon the needs of the particular imaging system. The migration layer 14 includes migration material 13 in layer 12 of softenable material. The migration material 13 may be continuous or particulate; but if continuous, should be "fracturable." By fracturable is meant that migration material is capable of being broken into particles before or during the image forming process. "Softenable material" as used herein means any substantially insulating material which can be rendered more permeable to migration migrating through its bulk.

The softenable material of layer 12 may comprise any suitable softenable material as defined above. Typical suitable softenable materials include polystyrenes, alkyd substituted polystyrenes, polyolefins, styreneacrylate copolymers, styrene-olefin copolymers, silicone resins, phenolic resins, and organic amorphous glasses. Typical materials are Staybelite Ester 10, a partially hydrogenated rosin ester, Foral Ester, a hydrogenated rosin triester, and Neolyne 23, an alkyd resin, all from Hercules Powder Co., SR 82, SR 84, silicone resins, both obtained from General Electric Corporation; Eastman Chemical; Velsicol X-37, a polysytrene-olefin copolymer from Velsicol Chemical Corp.; Hydrogenated Piccopale 100, a highly branched poly-olefin, HP-100, hydrogenated Piccopale 100, Piccotex 100, a copolymer of methyl styrene and vinyl toluene, Piccolastic A-75, 100 and 125, all polystyrenes, Piccodiene 2215, a polystyrene-olefin copolymer. all from Pennsylvania Industrial Chemical Co., Araldite 6060 and 6071, epoxy resins of Ciba; Amoco 18, a poly-alpha-methyl-styrene from Amoco Chem. Corp.; ET-693, and Amberol ST, phenol-formaldehyde resins, ethyl cellulose, and Dow C4, a methylphenylsilicone, all from Dow Chemical; N-140, a custom synthesized styrene-co-n-butylmethacrylate, R50601A, a phenylmethyl silicone resin from Dow Corning; Epon 1001, a bisphenol A-epichlorohydrin epoxy resin, from Shell Chemical Corp.; and PS-2, PS-3, both polystyrenes, and ET-693, a phenolformaldehyde resin, from Dow Chemical; and a custom synthesized 80/20 mole percent copolymer of styrene and hexylmethacrylate; and Nirez 1085, a polyterpene resin, available from Tenneco Corp. under that trade name.

Although any operable thickness for layer 12 of softenable material may be used, a satisfactory range for layer 12 thickness is from about 0.5 microns to about 16 microns. A range of from about 1 micron to about 4 microns is preferred for the reasons that such thicknesses provide for high quality images while permitting ready image member construction.

The migration material may comprise any suitable material. In various embodiments, the migration material may be photoconductive, photosensitive, photosensitively inert, electrically conductive, electrically insulating, magnetic colored, transparent, or have any other property depending upon its intended use in the particular embodiment.

Photosensitive as used herein more particularly means "electrically photosensitive." While photoconductive materials (and "photoconductive" is used in its broadest sense to mean materials which show increased electrical conductivity when illuminated with electromagnetic radiation and not necessarily those which have been found to be useful in xerography in a xerogrphic plate configuration) have been found to be a class of materials useful as "electrically photosensitive" materials in this invention and while the photoconductive effect is often sufficient in the present invention to provide an "electrically photosensitive" material, it does not appear to be a necessary effect. Apparently the necessary effect is the selective relocation of charge into, within, or out of the migration material; said relocation being effected by light action on the bulk or the surface of the electrically photosensitive material, by exposing said material to activating radiation; which may specifically include photoconductive effects, photoinjection, photoemission, photochemical effects and others which cause said selective relocation of charge.

Electrically photosensitive migration material is the particularly preferred migration material for reasons of convenience and variety of use, especially in cameras whereby the light action effect can be easily utilized, in conjunction with the electrical latent image setting of this invention.

The migration material 13 may comprise any suitable inorganic or organic photosensitive material. Typical inorganic materials are vitreous selenium, vitreous selenium alloyed with arsenic, tellurium, antimony or bismuth, etc.; cadmium sulfide, zinc oxide, cadmium sulfoselenide, and many others. U.S. Pat. No. 3,121,006 to Middleton et al and U.S. Pat. No. 3,288,603 set forth a whole host of typical inorganic pigments and suitable binders therefor which are hereby incorporated by reference. Typical organic materials are: Watchung Red B, a bariium salt of 1-(4'-methyl-5'-chloro-azo-benzene-2'-sulfonic acid)-2-hydrohydroxy-3-napthoic acid, C.I. No. 15865, available from DuPont; Indofast double scarlet toner, a Pyranthrone-type pigment available from Hamon Colors; quindo magenta RV-6803, a quinacridones, such as Monastral Red B (E. I. DuPont), Cyan Blue, GTNF the beta form of copper phthalocyanine, C. I. No. 74160, available from Collway Colors; Monolite Fast Blue GS, the alpha form of metal-free phthalocyanine, C. I. No. 74100, available from Arnold Hoffman Co.; Diane Blue, 3,3-methoxy-4,4'-diphenyl-bis(1-"azo-2" hydroxy-3"-naphthanilide), C. I. No. 21180, available from Harmon Colors; and Algol G. C., polyvinyl carbazole 1,2,5,6-di(D,D'-diphenyl)thiazole-anthraquinone, C. I. No. 67300, available from General Dyestuffs. The above list of organic and inorganic photosensitive materials is illustrative of some of the typical materials, and should not be taken as a complete listing.

The thickness of fracturable layered migration embodiments is preferably in the range between about 0.01 and about 2 microns, although fracturble layers of thickness of about 5 microns have been found to give good results for some materials. When the fracturable migration layer comprises discrete particles, a preferred average particle size is in the range of not greater than about 2 microns. Images of optimum density are produced by particles of average size not greater than about 0.7 microns.

The binder migration layer embodiments, as described in the previously referenced U.S. application Ser. No. 837,591 and layer embodiments preferably contain migration material particles of an average size not greater than about 2 microns. An optimum range for binder and layer configuration particles of migration material is an average size not greater than about 0.7 microns.

The FIG. 1 imaging member embodiment is in the layer configuration; i.e., the migration material 13 is layered in layer 12 of softenable material. This layer configuration, as defined above, means that the migration material 13 is layered in layer 12 of softenable material but spaced apart from one surface of the layer 12 of softenable material. The migration layer 14 may also be in the binder configuration (i.e., as defined above, the migration material 13 is dispersed within layer 12 of softenable material) for positive to negative working migration layers; that is, where migration takes place in exposed areas as opposed to the more typical binder operation of migration of particles taking place in the unexposed areas. In the binder configuration, the concentration of migration material 13 within layer 12 of softenable material is preferably sufficiently low to avoid rendering the migration layer either conductive or capable of transporting charges. For example, the positive to negative migration binder layer of selenium particles preferably has a concentration of 4.5 ($10^5$) particles of about 0.3$\mu$ average diameter per cubic centimeter when undergoing electrical latent image setting in accordance with the practice of this invention.

Substrate 11 may be electrically conductive or insulating. Conductive substrates generally facilitate the charging of the member and typically may be of metals, such as brass, copper, chromium, stainless steel, zinc, or may be of conductive plastics and rubbers. The conductive substrate may be coated on an insulator such as plastic, glass, or paper; for example, a substantially transparent tin oxide coated glass available under the trademark NESA from the Pittsburth Plate Glass Company.

The electrical latent image may be created by a wide variety of methods including charging through a stencil, electrostatic transfer of charge, charge induction methods and charge and expose methods. As example of the latter, the free surface of layer 12 of softenable material can be electrostatically charged such as, for example, by a corona discharge device of the general description and generally operated as disclosed in Vyverberg U.S. Pat. No. 2,836,725 and Walkup, U.S. Pat. No. 2,777,957, and exposed to electromagnetic radiation to which photosensitive migration material 13 is sensitive; i.e., the electromagnetic radiation is actinic or activating with respect to photosensitive migration material 13. Typical types of actinic electromagnetic radiation include radiation from ordinary incandescent lamps, x-rays, beams of charged particles, infrared, ultraviolet and combinations thereof. Other charging techniques ranging from rubbing the member, to induction charging for example, as described in Walkup, U.S. Pat. No. 2,934,649 are available in the art. Where substrate 11 is an insulating material or where there is no substrate 11, charging of the member, for example, may be accomplished by placing a conductive surface in contact with the member. Alternatively, other methods known in the art of xerography for charging xerographic plates having insulating backings may be applied. For example, the member may be charged using double sided corona charging techniques where two corona charging devices on each side of the member and oppositely charged are traversed in register relative to member 10. Charge densities producing an electric field across migration layer 14 of from about 5 volts per micron to about 200 volts per micron are satisfactory; a range of from about 40 volts per micron to about 100 volts per micron being preferred.

The life of the electrical latent image can be extended, when set in accordance with the practice of this invention, over the life of the electrical latent image for the particular migration layers lacking the beneficial setting step of the invention. The extended life may comprise extended life against time, extended life against light, and combinations thereof. The term "set" as used herein and as applied to the electrical latent image, and variations thereof such as "setting," is used herein to mean either providing life against time, or providing life against light, or combinations thereof. Thus, the phrase "set electrical latent image" is used herein to include an electrical latent image which is less affected by, either time, or light, or both, than an electrical latent image which has not been set.

As examples of the extension of life against time and life against light, it was discovered that an imaging member of the type depicted in FIG. 1 wherein the migration layer 14 comprises selenium particles as electrically photosensitive migration material 13 in layer configuration in the layer 12 of softenable material comprising about 95% by weight a copolymer of polystyrene and hexylmethacrylate of a molecular weight of about 45,000 weight average and about 5% by weight p-phenyl phenol formaldehyde resin, having latent image formed under charging to positive polarity, had no life against light and had a 30 minute life against time. That is, the positive electrical latent image could not be exposed to light (actinic electromagnetic radiation) prior to the imaging development step and would allow a delay between creation of the electrical latent image and the development step of only some 30 minutes before loss in sensitometry and quality occurred. A delay of 60 minutes between creation of the electrical latent image and the development step resulted in a 10% loss in sensitometry and quality; similarly, a 2 hour delay resulted in a 40% loss in sensitometry and quality. In accordance with the practice of this invention it was discovered that subjecting the migration layer 14 to a pre-softening step such as, for example, solvent vapor, which was insufficient to allow development (i.e., migration of migration material in depth) would extend the life of the positive electrical latent image to more than 1 day and render the positive electrical latent image insensitive to light (actinic electromagnetic radiation). That is, during this period the positive electrical latent image was not destroyed upon periodic exposure to actinic electromagnetic radiation; and, upon being developed at the end of that time, evidenced no change in sensitometry, resolution and quality.

As a further example, a similar imaging member containing as layer 12 of softenable material the copolymer of polystyrene and hexylmethacrylate, and having a negative electrical latent image, has virtually an infinitely long life against time when kept in the dark commencing immediately after creation of the electrical latent image. That is, after creation of a negative electrical latent image, the negative electrical latent image will, upon development, show no change in sensitometry, resolution and quality irrespective of the time delay between creation of the electrical latent image and the development step so long as the negative electrical latent image is stored in the dark. If, at any time within about 200 minutes after its creation, and before development, the negative electrical latent image is exposed to light (actinic electromagnetic radiation) the electrical latent image will be at least degraded and could be destroyed or obliterated. After storage in the dark for approximately 200 minutes, the negative electrical latent image acquires life against light; i.e., is less sensitive to subsequent periodic exposure to actinic electromagnetic radiation. The electrical latent images have been developed in ambient light, after storage in the dark, for a period of at least four years and, in some cases, for longer periods, without loss in sensitometry, resolution and quality. Applying gentle heat to the negative electrical image bearing migration layer such as, for example, at 70° C for about 10 seconds or for about 75° C for about 1 second, similarly extends the life against light of the negative electrical latent image. After applying gentle heat in lieu of dark storage, a delay of at least 4 years between the creation of the negative electrical latent image and the development step resulted in a less light sensitive electrical latent image which could be developed at the end of 4 years without any evidenced loss in sensitometry, resolution and quality.

Imaging occurs when the migration layer is subjected to the developing step. The developing step reduces the resistance of the softenable material to migration material sufficiently to allow migration of the migration material in depth in the softenable material. This may be accomplished by subjecting the migration layer to either heat, partial solvent, solvent vapor, or combinations thereof. Any suitable solvent may be used for partial solvent liquid or solvent vapor softening of the imaging member. Typical solvents are Freon TMC available from DuPont; trichloroethylene, chloroform, ethyl, xylene, dioxane, benzene, toluene, cyclohexane, 1,1,1-trichloroethane, pentane, n-heptane, Odorless Solvent 3440 (Sohio), Freon 113, available from DuPont; mxylene, carbon tetrachloride, thiophene, diphenyl ether, pcymene, cis-2, 2-dichlorethylene, nitromethane, N,N-dimethyl formide, ethanol, ethyl acetate, methyl ethyl ketone, ethylene dichloride, methylene chloride, 1,1-dichloroethylene, trans 1,2-dichloroethylene, and super naphtholite (Buffalo Solvents and Chemicals), and various mixtures thereof.

It will be appreciated that the heat, solvent vapor, partial solvent liquid and combinations thereof employed during the development step can advantageously be used in the practice of setting the electrical latent image in accordance with this invention. Of course, in setting the electrical latent image the application of heat, solvent vapor, partial solvent liquid or combinations thereof is carried out for a period of time which is sufficient to allow setting but insufficient to decrease the resistance of softenable material to the migration of migration material 13 to allow migration. For example, where applying heat at about 75° C for about 1 second is sufficient for setting the electrical latent image by the application of heat; then applying heat at the temperature of about 110° C for about 20 seconds would be required, generally, for sufficiently reducing the resistance of the softenable material to migration of migration material 13 to allow migration of migration material 13 in depth in the softenable material. Suitable development methods include those described in U.S. Pat. No. 3,520,681 and in U.S. application 483,675 filed Aug. 30, 1965, now U.S. Pat. No. 3,656,990, both of which are hereby incorporated by reference.

Modification of the softenable material may be employed to achieve long lived migration layers; i.e., to extend shelf life of the member. Generally, skin forming materials such as those disclosed in U.S. application, Ser. No. 6,862, filed Jan. 29, 1970, hereby incorporated by reference; materials having polar groups such as those disclosed in U.S. application Ser. No. 93,837 filed Nov. 30, 1970, hereby incorporated by reference; and materials which oxidize as disclosed in U.S. application Ser. No. 93,908 filed Nov. 30, 1970, hereby incorporated by reference, may be added to the softenable material to provide a migration layer which can be electrically latently imaged a long time after being prepared without change in sensitometry resolution and quality of the image. Typical suitable additives denoted in the aforementioned applications include p-tertiarybutyl phenol formaldehyde and p-phenyl phenol formaldehyde resin, available under the respective trademarks Bakelite 2432 and Bakelite 5254 from Union Carbide Corp.; halides such as carbon chlorine compounds, esters, ethers, epoxys, quaternary amines, alcoholic hydroxyl compounds, organic acids such as acidic hydroxyl compounds for example phenolic and cyanuric acid, sulfonic acid, carboxylic acid, and the metal salts of these organic acids such as the metal salts of 1, 3, 5-tri (M-phenoxy-phenoxy-phenyl) cyanurate, hydroperoxides, and peroxides.

The long life of the migration layer is to be distinguished from the long life of the electrical latent image. The former overcomes deterioration with time, primarily prior to electrical latent imaging, of the film's capability to provide images without quality loss where the film developed even immediately after electrical latent imaging. The latter overcomes deterioration with either time, or light, or both, of the electrical latent image during a delay prior to development.

Typical satisfactory weight percentages of additives are from about 0.1% to about 50% by weight of the softenable material weight. Preferred ranges are from about 0.1% to about 7%. Beyond 7% no perceivable extension of migration layer life is observed with increasing amounts of additives. The additives may be incorporated into the softenable material of layer 12 as described in the three aforementioned applications referenced with respect to said additives and used in accordance with the procedures described therein.

The combination of long life migration layers and set electrical latent images can be further combined advantageously with the erasure of migration layer electrical latent images disclosed in U.S. application Ser. No. 184, filed on Jan. 2, 1970, hereby incorporated by reference. A migration layer film (i.e., a film of migration imaging member) having these three characteristics can be used in a camera such as that disclosed in U.S. Pat. No. 3,528,355, hereby incorporated by reference; such an arrangement provides the capability of storing the film in the camera for long periods of time prior to electrically latently imaging, the capability of setting the electrical latent image once it is created and storing same on the film for long periods of time prior to development or erasure, and the capability of erasing film of its electrical latent image prior to development where desired. Such an arrangement is ideally suited for monitoring or surveillance situations such as bank security cameras; gauge and dial surveillance such as in refineries, medical operating rooms, laboratories and the like. One could activate the camera and record activities such as, for example, bank patrons during business hours. After an uneventful day, the electrical latent images could be erased and the film re-used the next business day. In the event of an unfortunate happening, the set electrical latent images could be developed at any time subsequent thereto within the extended life term for the particular parameters employed, as previously discussed. The electrical latent images could be developed even after exposure to light such as when the camera is purposely or accidently damaged so as to expose the film to activating electromagnetic radiation or light, in cases where the set electrical latent images have life against light. All, without change in sensitometry, quality and resolution of the image.

The phenomemon of electrical latent image setting is believed to be related to the decay of surface charge, i.e., charge residing on the surface of the layer 12 of softenable material. Charge decay from the surface of layer 12 of softenable material occurs in both positive and negative electrical latent images but has been observed to occur faster in the case of a negative electrical latent image. It will be appreciated, therefore, that the duration of the setting step will vary according to the particular softenable material employed in that the charge decay rate varies from softenable material to softenable material. The mechanism that occurs during surface charge decay and which allows or causes electrical latent image setting or stabilization is not known; but it is believed that, during the surface charge decay, the decaying charge becomes associated with the migration material and that it is this association which somehow stabilizes and extends the life of the electrical latent image in time, or stabilizes and extends the life of the electrical latent image by rendering it less light sensitive, or combinations of both, as the case may be.

It is believed that, during the surface charge decay, the decaying charge in the background areas becomes less or not available to the migration material even when the migration material is subsequently exposed to light and developed, thus rendering the background areas less light sensitive so that less or no washout of the set electrical latent image occurs. It is also believed that combinations of the two proposed mechanisms account for preservation of sensitometry by setting; for example, in the setting of continuous tone images.

Figure 2:
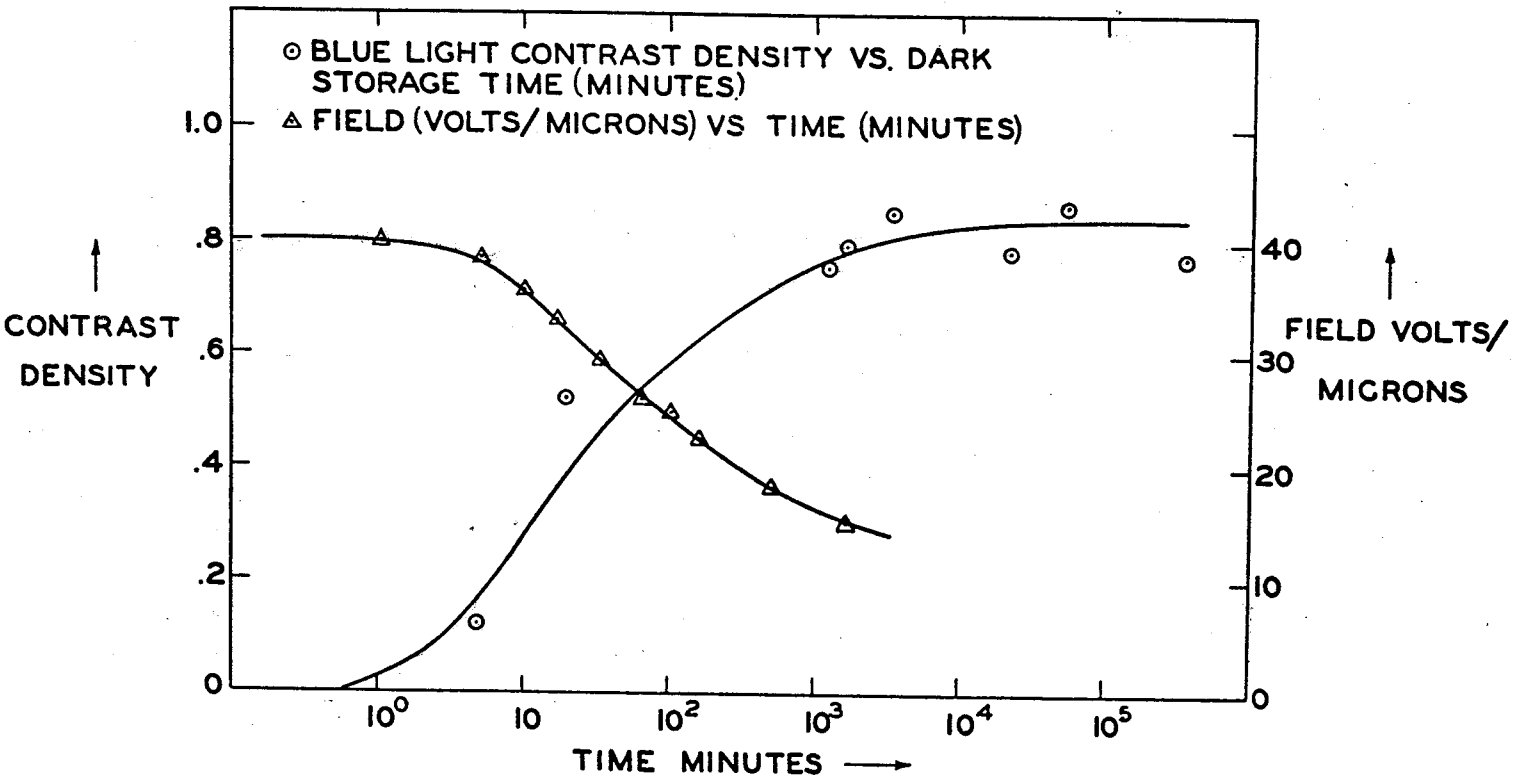
FIG. 2 is a graph for electrically photosensitive selenium of the two plots of blue light contrast density of film developed in ambient activating radiation or given such an exposure before development and after electrical latent image setting versus dark storage time at room temperature after negatively charging and exposing and before ambient exposure and heat development; and, field (volts/micron) versus the time in minutes following charging and immediate exposing, but before heat development for a layered configuration migration layer imaging member as described in Example I except that the softenable layer is about 1.6 microns thick. Contrast density is defined as density of background minus density of image area.

FIG. 2 shows how the image contrast density improves with dark storage time. The time required for maximum contrast and minimum field can be shortened from $10^2$ to $10^3$ minutes to a few seconds by heating the imaging member; e.g., on a hotplate at 110° C for about 2 seconds. It can be seen that the electrical field is dropping in time during dark storage consistent with maximum contrast. The field curve is a supporting basis for believing that charge decay is occurring.

Any suitable combination of setting step, charge polarity, and development step may be employed in the practice of this invention. However, it has been found that specific combinations are preferred in achieving the longer lived electrical latent images. One such combination is the use of a solvent vapor setting step and liquid development step with a positive electrical latent image. Another such preferred combination is the use of a heating setting step with a heating development step for negative electrical latent images. Although the specific combinations are currently preferred for obtaining the longest extension of life against light and life against time, any combination of the setting and developing steps may be applied to either the positively charged or negatively charged electrical latent images and the life of the latent electrical latent images may thereby be extended against either time, or light or combinations thereof.

The following Examples further specifically define the present migration image electrical latent image setting method of this invention. The parts and percentages are by weight unless otherwise indicated. The Examples below are intended to illustrate various preferred embodiments of the electrical latent image setting method of this invention.

EXAMPLE I

A layered configuration imaging member is made by forming an about 2 micron thick layer of a custom synthesized copolymer of polystyrene and hexylmethacrylate of a molecular weight of about 45,000 weight average on about a three mil thick substrate of Mylar polyester film from DuPont overcoated with a thin aluminum layer being about 50% visible light transmissive. The migration layer contiguous the free surface of the softenable layer is about ¼ micron layer of about ¼ micron selenium particles formed as disclosed in copending application Ser. No. 19,521, filed Mar. 17, 1970.

The member is uniformly electrically charged negatively to an applied field of about 50 volts/micron in strength, exposed to a light image with the exposure in the illuminated areas being about 10 ergs/cm$^2$ at 400 nanometers to form a negative charge electrical latent image.

This negative charge electrical latent imaged member is then heated in the dark for about 2 seconds on a hotplate at about 110° C. to set the image.

That the negative latent electrical image is set is demonstrated conclusively because the imaging member is then exposed uniformly to white room light for several seconds, up to a minute or more which ordinarily would be sufficient (absent the setting of this invention) to wash out the electrical latent image, and then heat developed by heating the member on a hotplate at about 110° C for about 20 seconds with, or alternatively without, the room lights on. The resulting heat developed migration image is comparable in density, background and quality to that obtained when the latent image is only immediately heat developed in the dark after formation of the electrical latent image.

EXAMPLE II

Example I is followed except that the development heating instead of being supplied by a hotplate is supplied for a few seconds with a focused microscope illuminator with a total exposure of better than 500,000 ergs/cm$^2$ at 400 nanometers. The resulting migration image is comparable to that of Example I which is quite dramatic because of the large amount of visible light accompanying the heat development.

EXAMPLE III

The first three paragraphs of Example I are followed except that positive charging to a field strength of about +35 volts/micron is used and that instead of heating to cause a slight softenin to cause setting, the slight softening is caused by exposing the electrically latent imaged member to trichlorotrifluoroethane vapor, the light available as Freon 113 from DuPont, for about 5 seconds after which no noticeable particle migration is observed.

Also, the softenable layer is different from the softenable layer of Example I in that the softenable layer material of Example I is mixed with about 5% Bakelite 5254, a p-phenyl phenol formaldehyde resin available from Union Carbide.

That the immediately above recited step causes the positive electrical latent image to be set is demonstrated because the latent imaged member is then exposed uniformly to actinic room light for several seconds which ordinarily (absent the setting of this invention) would be sufficient to wash out the electrical latent image and then developed by dipping in trichloroethane liquid. The resulting image showed no evidence of the room light exposure prior to the development even though this exposure would normally have washed out the image.

EXAMPLE IV

Example III is followed with similar results except that the slight pre-development softening is accomplished by dunking for about 5 seconds in, and removing the electrically latent imaged member from, Freon 113. The solvent Freon 113 is expressely chosen so that it does not soften the matrix enough in the immersion time to permit migration but only slightly softens the film to cause the electrical latent image to be set.

Films treated in this way may be handled in room light before development and extension of the positive electrical latent image life to between about 24 and 140 hours is noted.

EXAMPLE V

Example I is followed with similar results except that after the electrical latent image is formed, there is about 24 hours dark storage at room temperature in place of the 2 second hotplate heating whereupon the set electrically latent imaged member is exposed to ambient light and developed.

EXAMPLE VI

Example III is followed except that the setting contact to Freon 113 vapor is replaced by about a ½ second exposure to 1,1,1-trichloroethane vapor.

EXAMPLE VII

Example I is followed with over a year's time separating setting of the electrical latent image and the development heating steps.

EXAMPLE VIII

Example V is followed with over a year's time separating setting of the electrical latent image and the development heating steps.

EXAMPLE IX

Example I is followed except that the imagewise exposure is through an image target containing 300 line pairs per millimeter and over 4 years time separates the setting of the electrical latent image from the development heating step. No loss of resolution is detected.

EXAMPLE X

Example I is followed except that: the imaging member is uniformly charged to a field strength of about −40 volts/micron and is uniformly exposed to light for about 4 seconds through a 400 nanometer filter at an intensity of about 10 ergs per square centimeter; the imaging member is immediately stored in the dark for a period of about 3 days after which a residual surface charge potential of about −50 volts is observed; the imaging member is then positively charged through a metal mask to imagewise neutralize or erase the residual voltage; the imaging member is then heat developed at about 110° C for about 20 seconds with migration occurring predominantly in the negatively charged areas, that is, the areas which did not undergo imagewise neutralization.

EXAMPLE XI

Example I is repeated except that after the electrical latent image is set by heating on a hot plate at 110° C for about 2 seconds, the set electrical latent image is erased by uniformly charging the migration imaging member with positive charges and heating at about 110° C for about 20 seconds; then paragraphs two through four of Example I are followed to again create a set electrical latent image which is then subsequently developed.

In Examples XII - XXXIX, below, many samples of the imaging member of Example I are prepared. Example I is followed except that the quantity of negative charge used in creating the electrical latent image varies. Exposure is as in Example I except that it is through a resolution target of 228 line pairs per millimeter. Development is carried out as in Example I after various periods of delay between the setting of the electrical latent image and development. In all cases, setting is accomplished by storing the imaging member in the dark either at or below room temperature. Room temperature varied between about 20° C to about 25° C.

EXAMPLES XII - XXXIX

| Example | Volts | Dark Storage Setting Time (Room Temp. Unless Stated). | Room Light Exposure/Time | Resolution Line Pairs Per mm | Contrast Density White Light/Blue Light | |
|---|---|---|---|---|---|---|
| XII | −80 | 0 | NO | 228 | .47 | .90 |
| XIII | −70 | 24 hrs. | Yes/1 Min. | >220 | .40 | .71 |
| XIV | −70 | 360 hrs. | Yes/1 Min. | >220 | ~.26 | ~.78 |
| XV | −70 | 41 days | Yes/1 Min. | >220 | .43 | .86 |
| XVI | −70 | 8.5 Months | Yes/1 Min. | >220 | .35 | .77 |
| XVII | −70 | 0 | NO | >220 | .45 | .90 |
| XVIII | −70 | 31 hrs. | YES | >220 | .43 | .79 |
| XIX | −60 | 52 hrs. | YES | >220 | .44 | .85 |
| XX | −75 | 52 hrs. | YES | >220 | .42 | .78 |
| XXI | −70 | 8.5 Months | NO | >220 | .40 | .86 |
| XXII | −85 | 0 | NO | >220 | .55 | .95 |
| XXIII | −80 | 6 Months | Yes/1 Min. | >220 | .60 | .92 |
| XXIV | −80 | 6 Months | Yes/1 Min. | >220 | .60 | .92 |
| XXV | −80 | 6 Months | Yes/1 Min. | >220 | .60 | .92 |
| XXVI | −80 | 6 Months | Yes/1 Min. | >220 | .60 | .92 |
| XXVII | −40/μ | 0 | NO | 228 | .97 | |
| XXVIII | −40/μ | 22 hrs. (5° C) | NO | 228 | .92 | |
| XXVIX | −40/μ | 22 hrs. (5° C) | Yes/1 Min. | N.M. | .21 | |
| XXX | −40/μ | 22 hrs. | NO | 228 | 1.00 | |
| XXXI | −40/μ | 22 hrs. | Yes/1 Min. | N.M. | .69 | |
| XXXII | −88/μ | 0 | NO | 228 | .96 | |
| XXXIII | −88/μ | 24 hrs. (5° C) | NO | 228 | .99 | |
| XXXIV | −88/μ | 24 hrs. | NO | 228 | 1.03 | |
| XXV | −88/μ | 24 hrs. | Yes/1 Min. | N.M. | .79 | |
| XXXVI | −40/μ | 0 | NO | 228 | .87 | |
| XXXVII | −40/μ | 0 | Yes/1 min. | N.M. | 0.00 | |
| XXXVIII | −40/μ | 20 Min. | Yes/1 Min. | N.M. | .52 | |
| XXXIX | −40/μ | 5 Min. | Yes/1 Min. | N.M. | .12 | |

NOTE: N.M. means "not measured".

EXAMPLE XL

The imaging member of Example I is prepared in accordance with Example I. The member is charged negatively to about −53 volts/micron, and an electrical latent image is created by imagewise exposing with exposure as in Example I, through a resolution target having 322 line pairs per millimeter and stored in the dark for about 24 hours to set the electrical latent image. The member is charged to a field strength of about +53 volts/micron and heated at 110° C. for about 60 seconds. Erasure is demonstrated by observing that no migration occurs during the heating of the imaging member to 110° C. for about 60 seconds and that no image appears. A small residual positive voltage of about 3 volts is measurd.

EXAMPLE XLI

Example XL is repeated a total of 15 times. After creating the set electrical latent image for the sixteenth time, the positive charging step is omitted and the member is developed by heating the member on a hotplate at about 110° C. for about 60 seconds. An image appears corresponding to the sixteenth imagewise exposure through the resolution target, with a resolution greater than 300 line pairs per millimeter. This demonstrates recycling and ultimate development of a member having electrical latent images set by dark storage.

EXAMPLE XLII

Example XL is followed except that the electrical latent image is set by applying heat at about 110° C. for about 2 seconds in lieu of the 24 hour dark storage and that the resolution target has 228 line pairs per millimeter.

EXAMPLE XLIII

Example XLII is repeated a total of 25 times. After creating the electrical latent image for the twenty-sixth time, the erasure step is omitted and the member is developed by heating the member on a hotplate at 110° C. for about 60 seconds. An image appears corresponding to the twenty-sixth imagewise exposure through the resolution target, with a resolution of about 228 line pairs millimeter. This demonstrates recycling and ultimate development of a member having electrical latentimages set by heating.

EXAMPLE XLIV

Example I is followed except that the uniform negative charge results in an applied field of about −40 volts/micron in strength, the light image exposure is through a resolution target having 228 lines per millimeter, and setting is accomplished by dark storage. After more than 4 years and 1 month have elapsed, the imaging member is exposed to ambient light and developed as in Example I to yield an image having a resolution of 228 line pairs per millimeter.

Although specific components and proportions have been stated in the above description of preferred embodiments of this invention other suitable materials, as referred to herein, may be used with satisfactory results and various degrees of quality. In addition, other materials which exist presently or may be discovered may be added to materials used herein and variations may be made in the various processing steps to synergize, enhance, or otherwise modify the invention.

It will be understood that various other changes in the details, materials, steps and arrangements of parts, which have been herein described and illustrated in order to explain the nature of the invention, will occur to and may be made by those skilled in the art upon a reading of this disclosure and such changes are intended to be included within the principle and scope of this invention.

For example, setting may be done imagewise with vapor softening through a mask onto an imaging member which has been uniformly positively charged and uniformly exposed to actinic electromagnetic radiation. After vapor softening imagewise, the imaging member is stored in the dark for a period of time sufficient to allow background areas (those not vapor softened imagewise) to lose their response to exposure (i.e., to allow charge decay). The imaging member now has a set positive electrical latent image which can be later developed by the conventional migration imaging development techniques of either wash-away development or vapor development. The set electrical latent image has extended life against light and extended life against time.

As a further example of variations of the invention, a set negative electrical latent background image may be created by uniformly negatively charging an imaging member in the dark imagewise heating the member with heat in the dark (e.g., on a hotplate at 110° C for about 2 seconds, or higher temperatures on longer times) and then uniformly exposing the imaging member to ambient or room light. At this point, the background areas can be set with setting heat (e.g., on a hotplate at 110° C for about 2 seconds). Upon conventional migration imaging development with heat (e.g., on a hotplate at 110° for about 20 seconds) the heat set background areas will migrate and the imagewise heated areas do not migrate.

In embodiments where migration material is non-electrically photosensitive, the setting step causes the migration material to acquire charges which are typically in an imagewise pattern. Typically in non-electrically photosensitive migration material embodiments, the applied field strength is either in the upper range of applied field strengths previously mentioned or at higher values. These higher field strengths, it is believed, contribute to this result vis-a-vis the electrically photosensitive case.

As noted from the previously referenced migration imaging applications and as seen from the migration imaging patents the varying results of migration or non-migration in light-struck areas, the results of migration or non-migration in non-light struck (dark) areas, and the results of migration of non-migration of non-electrically photosensitive migration material depends upon many variables. Among these are: polarity of charge, magnitude of charge, processing steps used, character of the migration material, and character of the softenable material. Thus it can be seen that virtually limitless combinations of migration imaging techniques can be used in conjunction with the electrical latent image setting practice of the instant invention. Also, multiple set electrical latent images may be created on the same imaging member. For example, an electrical latent image of a rectangle and one of a triangle may both successively be formed and set on an imaging member, and, upon development, both set electrical latent images will migrate imagewise. Where the two migrated images intersect, the common area is of greater density than non-common, non-intersected areas of the migrated images. It will be appreciated that multiple set electrical latent images can be utilized on a migration imaging member to produce continuous tone images.

The multiple set image capability lends itself to many convenient applications. For example, the manufacturer or supplier of migration imaging members, films, etc. could form a set electrical latent image in the configuration of a code notation, or a tax form, or any specialized form, notation or image and vend the migration imaging member to consumers. The consumers can then form one or more set electrical latent images to complete the form, for example. Upon conventional migration imaging development, all set electrical latent image areas will migrate and provide images corresponding to the vendor's form, etc. and the consumer's added information.

What is claimed is:

1. An imaging method, comprising:

(A) providing an imaging member comprising a migration layer comprising migration material and substantially electrically insulating softenable material, said softenable material capable of having its resistance to migration of migration material decreased sufficiently to allow migration of migration material in depth in said softenable material;

(B) providing said imaging member with an electrical latent image; and (C) setting said electrical latent image by softening said softenable material without decreasing the resistance of the softenable material to migration of migration material sufficient to allow migration of migration material in depth in said softenable material.

2. The method of claim 1 wherein said migration material comprises particles of an average diameter of up to about 0.7 microns.

3. The method of claim 1 wherein said migration layer has a thickness from about 1 micron to about 4 microns.

4. The method of claim 1 wherein said softenable material comprises a copolymer of polystyrene and hexylmethacrylate of a molecular weight of about 45,000 weight average.

5. The method of claim 4 wherein said softenable material comprises about 95% by weight a copolymer of polystyrene and hexylmethacrylate of a molecular weight of about 45,000 weight average and about 5% by weight p-phenyl phenol formaldehyde resin.

6. The method of claim 1 wherein said step (C) setting comprises vapor setting.

7. The method of claim 1 wherein said step (C) setting comprises heat setting.

8. The method of claim 1 wherein said step (C) setting comprises liquid setting.

9. The method of claim 7 wherein said heat is applied at about 70° C. for about 10 seconds.

10. The method of claim 7 wherein said heat is applied at about 110° C. for about 2 seconds.

11. The method of claim 1 further including the step (d) of erasing said set electrical latent images.

12. The method of claim 11 wherein said steps (b) through (d) are reported at least once.

13. The method of claim 12 further including the performance of only steps (b) and (c) at least one more time.

14. The method of claim 13 further including developing said electrical latent image by decreasing the resistance of the softenable material to migration of migration material sufficient to allow migration of migration material in depth in said softenable material.

15. The method of claim 1 further including the step (D) of decreasing the resistance of said softenable material to migration of migration material sufficient to allow migration of migration material in depth in said softenable material.

16. The method of claim 15 wherein the migration material comprises electrically photosensitive migration material and wherein the migration material and softenable material are in a layer configuration.

17. The method of claim 16 wherein step (B) comprises charging the surface of the imaging member and exposing said member to activating electromagnetic radiation.

18. The method of claim 17 wherein the charging is accomplished with negative charges.

19. The method of claim 18 wherein the step (C) setting comprises heating the migration layer.

20. The method of claim 19 wherein the step (D) developing of said latent image comprises heating the migration layer.

21. The method of claim 17 wherein the charging is accomplished with positive charges.

22. The method of claim 21 wherein the step (C) setting comprises contacting the migration layer with solvent vapor.

23. The method of claim 22 wherein the step (D) developing of said latent image comprises contacting the migration layer with solvent vapor.

24. The method of claim 15 wherein the migration material comprises electrically photosensitive migration material and wherein the migration material and softenable material are in a binder configuration.

25. The method of claim 24 wherein said step (D) migration comprises reverse migration.

26. The method of claim 15 further including flooding said imaging member with activating radiation in between the step (C) setting and the step (D) developing.

27. The method of claim 15 further including flooding said imaging member with activating radiation during the step (D) developing.

28. A migration layer in an environment of activating electromagnetic radiation comprising migration material and substantially electrically insulating softenable material, said softenable material capable of having its resistance to migration of migration material decreased sufficiently to allow migration of migration material in depth in said softenable material, said migration layer having a set positive electrical latent image.

29. A method of creating a set positive electrical latent image, comprising:

(A) providing an imaging member comprising a migration layer comprising electrically photosensitive migration material and substantially electrically insulating softenable material, said softenable material capable of having its resistance to migration of migration material decreased sufficiently to allow migration of migration material in depth of said softenable material;

(B) setting the background by uniformly positively charging the surface of said imaging member and uniformly exposing said member to activating electromagnetic radiation;

(C) imagewise softening said softenable material with solvent vapor without decreasing the resistance of the softenable material to migration of migration material sufficient to allow migration of migration material in depth in said softenable material; and (D) storing said imaging member in the dark for a period of time sufficient to allow charge decay in background areas of said imaging member.

30. The method of claim 29 further including developing said set positive electrical latent image by contacting the imaging member with solvent vapor so as to decrease the resistance of the softenable material to migration of migration material sufficient to allow migration of migration material in depth in said softenable material.

31. A method of creating a set negative electrical latent background image, comprising:

(A) providing an imaging member comprising a migration layer comprising electrically photosensitive migration material and substantially electrically insulating softenable material, said softenable material capable of having its resistance to migration of migration material decreased sufficiently to allow migration of migration material in depth in said softenable material;

(B) uniformly negatively charging said imaging member;

(C) imagewise heating the imaging member;

(D) uniformly exposing the imaging member to activating electromagnetic radiation; and (E) uniformly softening and softenable material with heat without decreasing the resistance of the softenable material to migration of migration material sufficient to allow migration of migration material in depth in said softenable material.

32. The method of claim 31 further including developing said set negative electrical latent background image by applying heat to said softenable material so as to decrease the resistance of the softenable material to migration of migration material sufficient to allow migration of migration material in depth of said softenable material.

33. The method of claim 1 further including providing said imaging member with at least one additional set electrical latent image.

* * * * *